US007427132B2

(12) United States Patent
Sawai

(10) Patent No.: US 7,427,132 B2
(45) **Date of Patent: *Sep. 23, 2008**

(54) IMAGE FORMING APPARATUS

(75) Inventor: Kunio Sawai, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 444 days.

This patent is subject to a terminal disclaimer.

(21) Appl. No.: 11/173,154

(22) Filed: Jul. 5, 2005

(65) Prior Publication Data

US 2006/0001730 A1 Jan. 5, 2006

(30) Foreign Application Priority Data

Jul. 5, 2004 (JP) ..... 2004-197855

(51) Int. Cl.
*B41J 11/00* (2006.01)

(52) U.S. Cl. ..... 347/104; 347/197; 347/198; 347/220; 400/120.01; 400/120.16; 400/120.17

(58) Field of Classification Search ..... None
See application file for complete search history.

(56) References Cited

U.S. PATENT DOCUMENTS 5,005,026 A * 4/1991 Sakai ..... 347/197
5,181,787 A * 1/1993 Hosomi ..... 400/120.16
5,445,460 A * 8/1995 Nakajima ..... 400/120.16
5,746,520 A * 5/1998 Kohira ..... 400/120.01
5,846,003 A * 12/1998 Mori et al. ..... 400/120.17
5,940,108 A * 8/1999 Ito ..... 347/197
7,286,151 B2 * 10/2007 Sawai ..... 347/197

FOREIGN PATENT DOCUMENTS

JP 7-323587 A 12/1995

* cited by examiner

*Primary Examiner*—Matthew Luu
*Assistant Examiner*—John P Zimmermann
(74) *Attorney, Agent, or Firm*—Global IP Counselors, LLP

(57) ABSTRACT

An image forming apparatus has a chassis, a head portion, a platen roller a plurality of elastically deformable support rods, a U-shaped rotary member and a drive mechanism. The head portion is pivotally supported on the chassis. The platen roller is rotatably supported on the chassis opposite the head portion. The support rods are supported on the chassis. The rotary member is pivotally supported to the chassis by unrotatably engaging the support rods. A second side arm of the rotary member is configured to press the head portion against the platen roller with an urging force of the support rods. The drive mechanism is engaged with a first side arm of the rotary member to pivot the rotary member around the support rods. With the image forming apparatus. the head portion can be pressed on with a sufficient amount of pressure.

9 Claims, 9 Drawing Sheets

IMAGE FORMING APPARATUS

BACKGROUND OF THE INVENTION

1. Field of the Invention

The present invention relates to an image forming apparatus. More specifically, the present invention relates to an image forming apparatus that has a printing head for printing.

2. Background Information

Image forming apparatuses that have a thermal head or another such printing head have been known in the art. For example, Japanese Patent Application Publication No. 7-323587 discloses such image forming apparatus.

Japanese Patent Application Publication No. 7-323587 discloses a heat storing type printing apparatus (image forming apparatus) that has a thermal head (printing head), an intermediate transfer medium against which the thermal head is pressed with an ink sheet therebetween, a transfer device for transferring the ink that has been transferred onto the intermediate transfer medium onto a paper, and a thermal head moving mechanism for exerting pressure on the thermal head by the spring force of a tension coil spring. In this heat storing type printing apparatus, the ink from the ink sheet is transferred onto the intermediate transfer medium by the thermal head being pressed by the thermal head separation mechanism, and the ink transferred onto the intermediate transfer medium is transferred onto paper by the heat and pressure generated by the transfer device.

Heat transfer printers are also known as conventional image forming apparatuses. FIGS. 14 and 15 are perspective views showing the entire configuration of a conventional heat transfer printer. FIGS. 16 and 17 are perspective views of a pressing member and a support rod for describing the way in which the pressing member and the support rod are coupled to one another. FIG. 18 is a cross-sectional view for describing the pressing operation of a thermal head on a platen roller in the conventional heat transfer printer shown in FIGS. 14 and 15. The structure of the conventional heat transfer printer will now be described with reference to FIGS. 14 through 18.

As shown in FIGS. 14 and 15, a conventional heat transfer printer has a metal chassis 101, a thermal head 102 for printing, a platen roller 103, a metal support rod 104, a pressing member 105 having a toothed section, a pressing member 106 with no toothed section, a drive gear 107 having a resinous small gear 107*a* and large gear 107*b* for rotating the pressing member 105, a torsion coil spring 108, a resinous bearing plate 109 on which a platen roller bearing 109*a* is integrally formed, a resinous bearing plate 110 on which a platen roller bearing 110*a* is integrally formed, a motor 111, a motor bracket 112, and an intermediate gear 113.

Also, as shown in FIGS. 14 and 15, an insertion part 101*c* for mounting an ink sheet cartridge (not shown) is provided to the second side surface 101*b* that is opposite the first side surface 101*a*, on which the motor bracket 112 of the chassis 101 is mounted. Insertion holes 101*d* in which both ends of the support rod 104 are rotatably inserted are formed on the first side surface 101*a* and the second side surface 101*b* of the chassis 101. Also, the thermal head 102 is mounted in between the first side surface 101*a* and second side surface 101*b* of the chassis 101 so as to be capable of pivoting around a support axle 102*a*. The torsion coil spring 108 is mounted on the support axle 102*a* of the thermal head 102. This torsion coil spring 108 functions to urge the thermal head 102 in a direction away from the platen roller 103. Also, a head unit 102*b*, which is the bottom portion of the thermal head 102, is disposed so as to face the platen roller 103. Bent parts 102*c* that are pressed on by the pressing members 105 and 106 are formed above both ends of the head unit 102*b* of the thermal head 102.

As shown in FIGS. 16 and 17, insertion parts 104*a* near both ends of the support rod 104 have a shape of a circle with its sides cut off, and are snugly inserted respectively into similarly-shaped insertion holes 105*a* and 106*a* formed in the pressing members 105 and 106 such that the pressing members 105 and 106 do not rotate relative to the insertion holes 105*a* and 106*a*. Also, bearing supports 104*b* are formed on the ends of the insertion parts 104*a* of the support rod 104. The bearing supports 104*b* are rotatably supported in the insertion holes 110*d* of the chassis 101. Press springs 105*b* and 106*b* for exerting pressure on the bent parts 102*c* of the thermal head 102 are mounted on the pressing members 105 and 106, respectively. Also, as shown in FIG. 18, the toothed section of the pressing member 105 is disposed so as to engage the small gear 107*a* of the drive gear 107. The small gear 107*a* is disposed so as to rotate integrally with the large gear 107*b*. Also, the drive gear 107 is mounted on the first side surface 101*a* of the chassis 101 and is made to transmit the drive force from the intermediate gear 113 to the pressing member 105. The drive force of the motor 111 (see FIG. 15) mounted on the motor bracket 112 is transmitted to the large gear 107*b* of the drive gear 107 via the intermediate gear 113 (see FIG. 18).

In the operation of the conventional heat transfer printer described above and shown in FIG. 18, in which the thermal head 102 applies pressure to the platen roller 103, the drive force from the motor 111 (see FIG. 15) is transmitted to the toothed section of the pressing member 105 via the intermediate gear 113 and the large gear 107*b* and small gear 107*a* of the drive gear 107, such that the pressing member 105 pivots while being supported in the insertion holes 101*d* of the chassis 101. The bent part 102*c* on the side of the first side surface 101*a* of the chassis 101 is thereby pressed on by the press spring 105*b* of the pressing member 105. Also, since the pressing members 105 and 106 are mounted on the support rod 104 snugly so as not to rotate relative to each other, the support rod 104 and the pressing member 106 are pivoted by the pivoting of the pressing member 105. The bent part 102*c* on the side of the second side surface 101*b* of the chassis 101 is thereby pressed on by the press spring 106*b* of the pressing member 106, as shown in FIG. 15. As a result, the head unit 102*b* of the thermal head 102 is pressed on toward platen roller 103 against the urging force of the torsion coil spring 108.

In the conventional heat transfer printer shown in FIGS. 14 through 18, the insertion parts 104*a* at both ends of the metal support rod 104 are formed into an elongated circular shape in order to non-rotatably couple the pressing members 105 and 106, which exert pressure on the thermal head 102 and the support rod 104. Time-consuming cutting processes are required in order to form the metal support rod 104 into the elongated circular shape in this manner. Therefore, an unacceptably long time is required to form the members for exerting pressure on the thermal head 102. Furthermore, the diameter of the bearing supports 104*b* on the outer ends of the insertion parts 104*a* must be equal to or smaller than the width of the elongated circular portions of the insertion parts 104*a*. Accordingly, the same cutting processes are required to form the bearing supports 104*b*. Therefore, it takes even longer time to manufacture the components.

In the structure disclosed in Japanese Patent Application Publication No. 7-323587, although it is not clearly described, the thermal head separation mechanism appears to be pressed against the thermal head by the spring force of a single tension coil spring. Therefore, it is difficult to apply pressure to the thermal head with a sufficient amount of pressure during printing.

In view of the above, it will be apparent to those skilled in the art from this disclosure that there exists a need for an improved image forming apparatus that overcomes the problems of the conventional art. This invention addresses this need in the art as well as other needs, which will become apparent to those skilled in the art from this disclosure.

SUMMARY OF THE INVENTION

It is an object of this invention to provide an image forming apparatus in which the head portion can be pressed on with a sufficient amount of pressure, and the time necessary for forming the members for exerting pressure on the head portion can be reduced.

The image forming apparatus according to the first aspect of the present invention includes a chassis, a head portion pivotally supported on the chassis, a platen roller rotatably supported on the chassis opposite the head portion, a plurality of elastically deformable support rods supported on the chassis, a U-shaped rotary member pivotally supported to the chassis by unrotatably engaging the support rods, the rotary member having a first side arm, a second side arm, and a linking section for linking the first side arm and the second side arm, the second side arm being configured to press the head portion against the platen roller with an urging force of the support rods, a drive mechanism engaged with the first side arm of the rotary member to pivot the rotary member around the support rods.

In the image forming apparatus described above, the second side arm of the rotary member is configured so as to press the printing head against the platen roller using the pressure from the bending deformation of the plurality of support rods, such that the printing head can be pressed against the platen roller with a sufficient amount of pressure by utilizing the urging force from the bending deformation of the plurality of support rods during the printing operation.

Also, by providing a plurality of support rods in the rotary member, it is possible to reduce the cross-sectional area of each of the support rods that is required to sufficient urging force that is comparable to the urging force generated when only one single support rod is used. Since a support rod with a smaller cross-sectional area bends more easily than a support rod with a larger cross-sectional area, the maximum amount of bending of the support rod having a smaller cross-sectional area is therefore greater. As a result, although a support rod having a larger cross sectional area tends to be plastically deformed after a repeated use, it is possible to efficiently suppress plastic deformation even after the repeated use by using a plurality of support rods with a smaller cross-sectional area.

Also, since the U-shaped rotary member that has a first side arm, a second side arm, and a linking section that links the first side arm and the second side arm is pivoted by a drive mechanism, there is no relative rotation between the first side arm and the second side arm of the rotary member. Therefore, there is no need to form D-cuts or complicated oval shapes in order to prevent such relative rotation. The metal rotary member can thereby be formed easily and quickly by pressing, without having to perform time-consuming cutting operations. Accordingly, the time needed to form the rotary member can be reduced.

In the image forming apparatus according to the second aspect of the present invention, it is preferable that the rotary member be made of metal, and a resin-made pressing member is mounted on a distal end of the second side arm of the rotary member.

With such configuration, it is the resin made pressing member that comes into contact with the head portion when pressure is to be applied to the head portion. It is thereby possible to prevent the head portion from being damaged as a result of the metal rotary member coming into contact with the head portion.

The image forming apparatus according to the third aspect of the present invention preferably further includes a cap unit which is pivotally supported in the chassis and into which all ends of the plurality of support rods are inserted.

With such configuration, it is possible for the rotary member mounted on the plurality of support rods to be easily pivoted relative to the chassis via the cap unit.

In the image forming apparatus according the fourth aspect of the present invention, it is preferable that the linking section of the rotary member have a U-shaped cross sectional shape, and the plurality of support rods is accommodated within the U-shaped cross sectional shape of the linking section.

With such configuration, the control section can prevent the plurality of supports rods from bending excessively. Accordingly, plastic deformation resulting from excessive bending in the support rods can thereby be suppressed.

In the image forming apparatus according to the fifth aspect of the present invention, it is preferable that the drive mechanism have a cam groove, and the first side arm of the rotary member has a cam pin for engaging the cam groove.

With such configuration, the drive force of the drive mechanism can be transmitted to the rotary member using the cam groove and the cam pin. Accordingly, the second side arm of the rotary member can therefore be pivoted easily.

In the image forming apparatus according to the sixth aspect of the present invention, it is preferable that the pressing part of the second side arm of the rotary member be disposed positioned substantially at a center in a width direction of the head portion.

With such configuration, the amount of pressure to be applied to be the head portion by the second side arm of the rotary member can be balanced transversely in the width direction of the printing head. The printing head can thereby apply a transversely balanced pressure to the platen roller. Therefore, occurrences of printing non-uniformities can therefore be reduced.

In the image forming apparatus according to the seventh aspect of the present invention, it is preferable that the head portion be a thermal head.

In the image forming apparatus according to the eighth aspect of the present invention, it is preferable that the support rods be made of a piano wire.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

A heat transfer printer, which is an example of the embodiment of the present invention, will now be described with reference to the figures.

Figure 1:
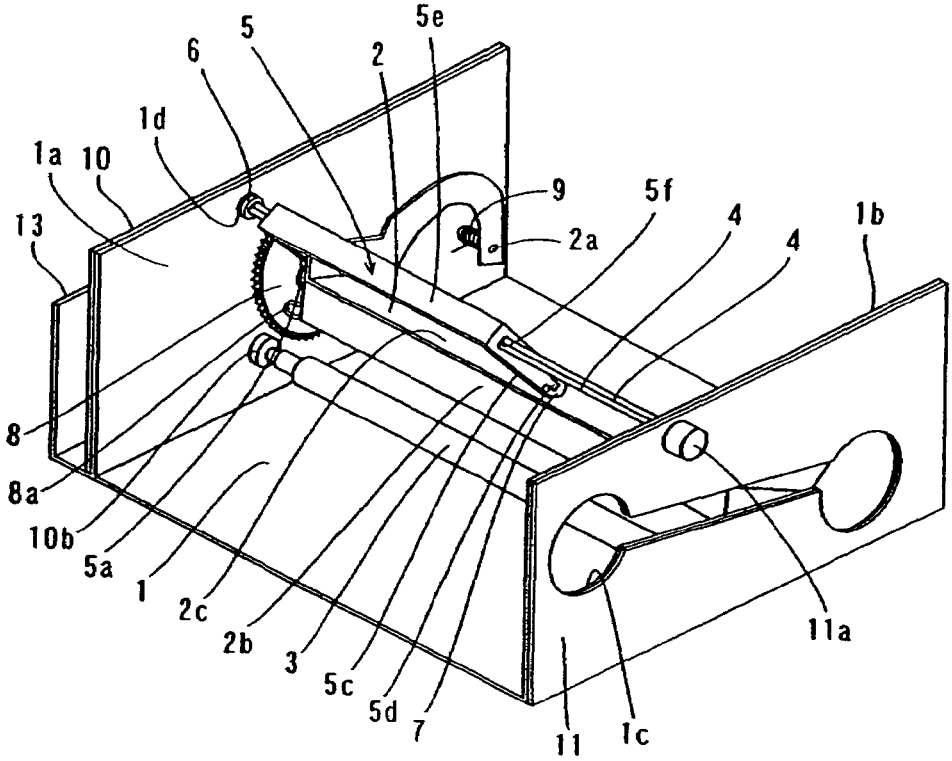
FIG. 1 is a perspective view showing the entire configuration of a heat transfer printer according to an embodiment of the present invention.
Figure 2:
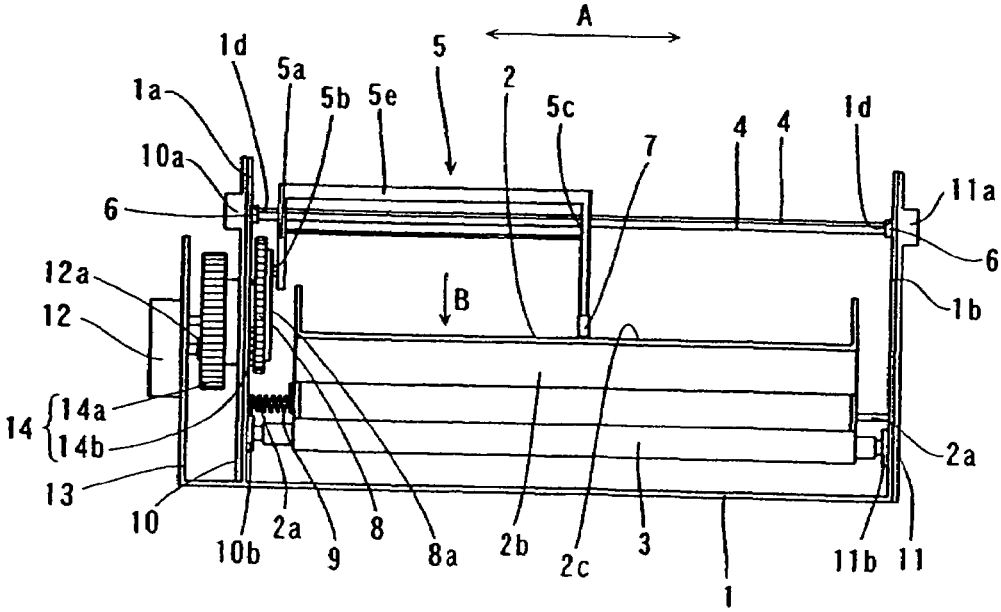
FIG. 2 is a front view of the heat transfer printer according to the embodiment shown in FIG. 1.
Figure 3:
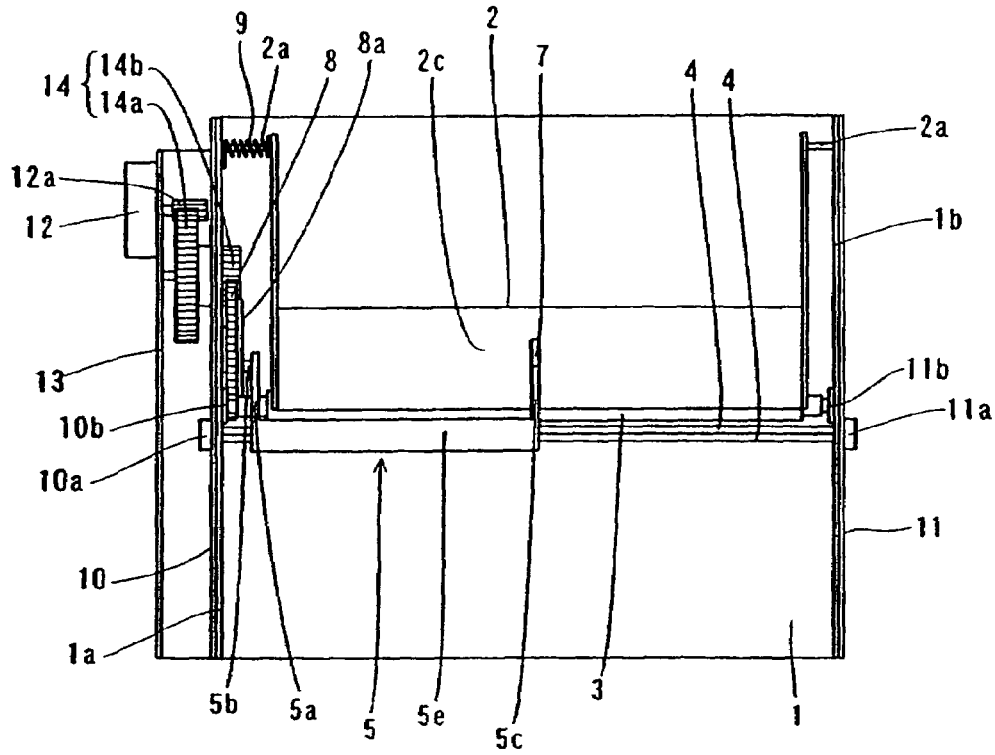
FIG. 3 is a plan view of the heat transfer printer according to the embodiment shown in FIG. 1.
Figure 8:
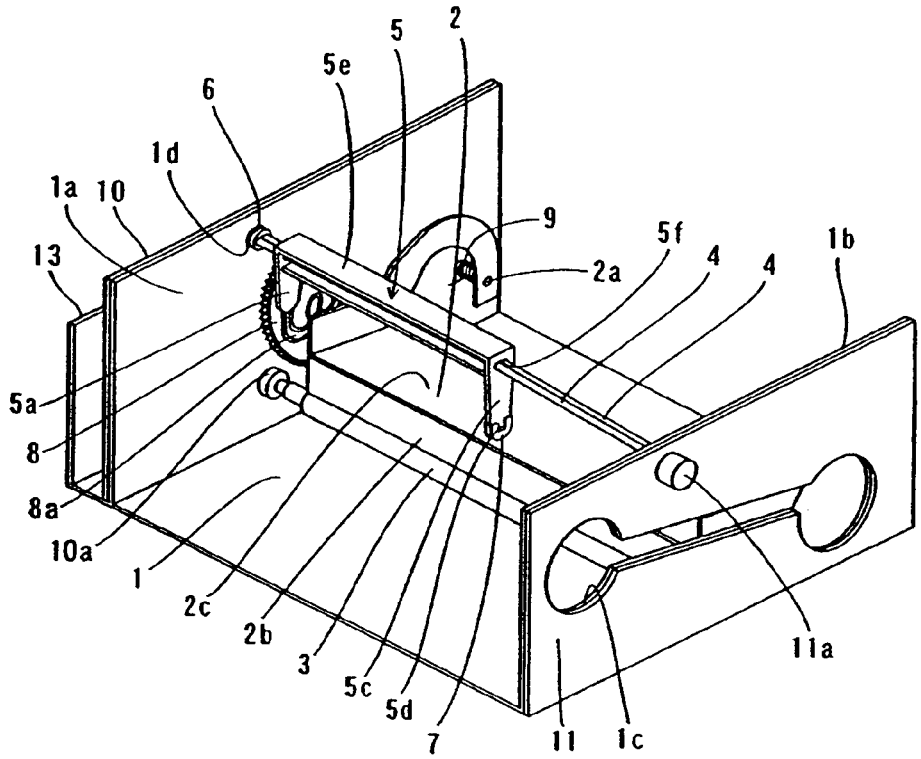
FIG. 8 is a perspective view of the heat transfer printer according to the embodiment shown in FIG. 1, when the rotary member applies pressure to the thermal head.
Figure 9:
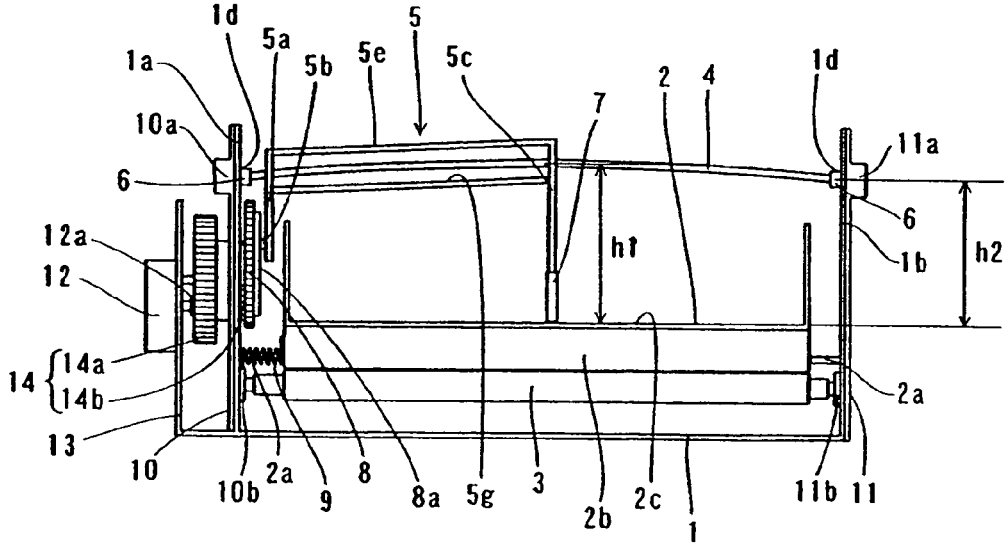
FIG. 9 is a front view of the heat transfer printer according to the embodiment shown in FIG. 1, when the rotary member applies pressure to the thermal head.
Figure 10:
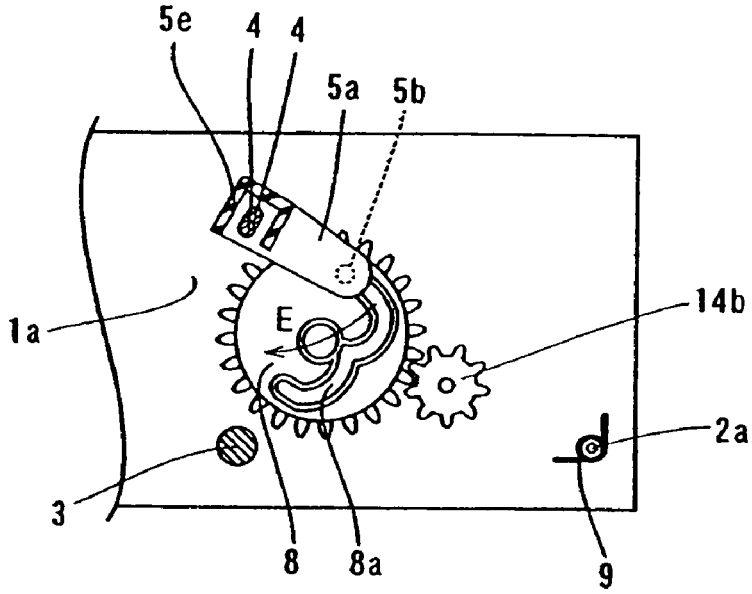
FIG. 10 is a schematic side view of the first side surface of the heat transfer printer according to the embodiment shown in FIG. 1, showing the relationship between the position of the rotary member and the drive gear when the rotary member is not pressing the thermal head.
Figure 11:
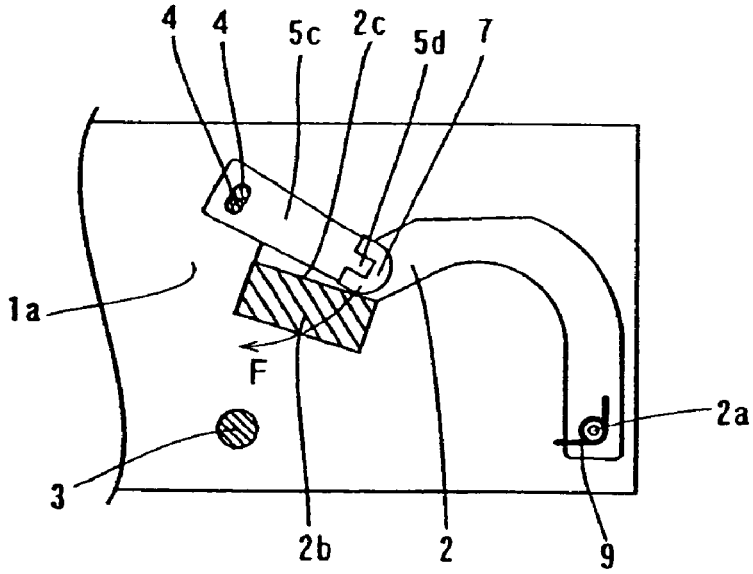
FIG. 11 is a schematic side view of the first side surface of the heat transfer printer according to the embodiment shown in FIG. 1, showing the relationship between the positions of the thermal head and the rotary member when the rotary member is not pressing the thermal head.
Figure 12:
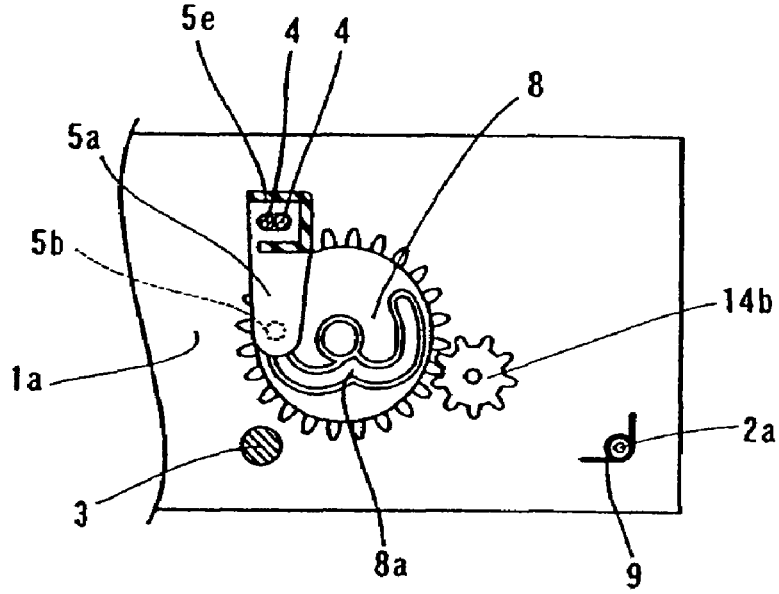
FIG. 12 is a schematic side view of the first side surface of the heat transfer printer according to the embodiment shown in FIG. 1, showing the relationship between the position of the rotary member and the drive gear when the rotary member is pressing the thermal head.

FIG. 1 is a perspective view showing the entire configuration of a heat transfer printer according to an embodiment of the present invention. FIG. 2 is a front view of the heat transfer printer shown in FIG. 1 according to the embodiment of the present invention. FIG. 3 is a top view of the heat transfer printer according to the embodiment of the present invention shown in FIG. 1. FIGS. 4 through 7 are diagrams showing the detailed structure of the support rods, the rotary member, and the cap unit in the heat transfer printer shown in FIG. 1 according to the embodiment of the present invention. FIGS. 8 and 9 are diagrams showing a state in which the thermal head is pressed against the platen roller in the heat transfer printer according to the embodiment of the present invention.

The structure of the heat transfer printer according to the embodiment of the present invention will now be described with reference to FIGS. 1 through 9. In the present embodiment, a heat transfer printer will be discussed as one example of an image forming apparatus of the present invention.

As shown in FIGS. 1 through 3, the heat transfer printer according to one embodiment of the present invention has a metal chassis 1, a thermal head 2 for printing, a platen roller 3, two metal support rods 4 that are capable of undergoing bending deformation, a metal pivoting member 5, resinous cap units 6, a resinous pressing member 7, a drive gear 8 for pivoting the pivoting member 5, a torsion coil spring 9, resinous bearing plates 10 and 11, a motor 12 having a motor axle gear 12*a*, a metallic motor bracket 13, and an intermediate gear 14 having a large gear 14*a* for engaging the motor axle gear 12*a* and a small gear 14*b* for engaging the drive gear 8. The thermal head 2 is an example of the "head portion" of the present invention. Also, the drive gear 8 is an example of the "drive mechanism" of the present invention.

The motor bracket 13 is mounted on the first side surface 1*a* of the chassis 1, as shown in FIGS. 1 through 3. An insertion part 1*c* through which ink sheet cartridges (not shown) are mounted is provided to the second side surface 1*b*, which is opposite the first side surface 1*a*. Also, the thermal head 2 is mounted in between the first side surface 1*a* and the second side surface 1*b* of the chassis 1 so as to be capable of pivoting around a support axle 2*a*. A head unit 2*b* provided at the bottom of the thermal head 2 is disposed so as to face the platen roller 3.

Figure 4:
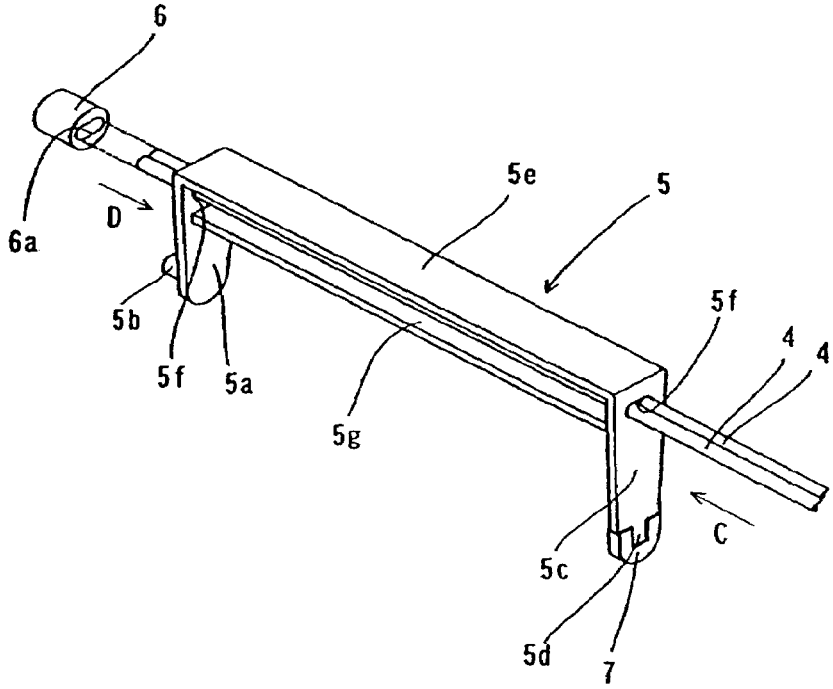
FIG. 4 is a perspective view of the detailed structure of the support rods, the rotary member, and the cap unit of the heat transfer printer according to the embodiment shown in FIG. 1.

The detailed structure of the two metal support rods 4, the pivoting member 5, and the cap units 6 according to the present embodiment will now be described with reference to FIGS. 4 through 7. Two support rods 4 that are capable of undergoing bending deformation are mounted on the pivoting member 5, as shown in FIG. 4. These two support rods 4 are composed of piano wire.

In the present embodiment, the two piano-wire support rods 4 capable of undergoing bending deformation are provided, such that the cross sectional area of each rod can be reduced. In this embodiment, the support rods 4 are manufactured such that the sum of the cross-sectional areas of the support rods 4 is approximately the same as the cross sectional area of a support rod that is designed to be used singularly in the heat transfer printer. For example, if only one support rod having a diameter of 3.2 mm is used, the cross sectional area of this support rod is about 8.04 $mm^2$. When two support rods 4 are used, as in the present embodiment, the cross sectional area A of each rod is reduced to about 4.02 $mm^2$ if they are configured such that the total of the cross sectional areas of the two support rods 4 is about 8.04 $mm^2$, which is the same as the cross sectional area of the one support rod. At this time, according to the formula $A=\pi r^2$, the radius r of each of the support rods 4 is about 1.13 mm, and the diameter (2r) of the support rods 4 is about 2.26 mm. The diameter of each of the support rods 4 (about 2.26 mm) is less than the diameter of the one support rod (3.2 mm).

When two support rods are used as described above, it is possible to reduce the cross sectional area and diameter of the support rods as compared with the case where one support rod is used. Since a support rod with a smaller cross-sectional area bends more easily than a support rod with a larger cross-sectional area, the maximum amount of bending of the support rod having a smaller cross-sectional area is therefore greater. As a result, it is possible to control the amount of deflection more easily. Particularly, when there is a dimensional error in the support rods 4, such dimensional error is less likely to affect the printing operation, since the dimensional error can be absorbed by the bending of the support rods 4. Furthermore, although a support rod having a larger cross sectional area tends to be plastically deformed after a repeated use, it is possible to efficiently suppress plastic deformation even after the repeated use by using a plurality of support rods with a smaller cross-sectional area.

In the present embodiment, as shown in FIG. 4, the metal pivoting member 5 has a square shape composed of a first side arm 5*a*, a second side arm 5*c*, and a linking section 5*e* that links the first side arm 5*a* and the second side arm 5*c*. The first side arm 5*a* of the pivoting member 5 is provided with a cam pin 5*b* that engages a cam groove 8*a* in the drive gear 8 described later. Also, a pressing part 5*d* for exerting pressure on the thermal head 2 is provided to the second side arm 5*c*. The first side arm 5*a* and second side arm 5*c* of the pivoting member 5 are provided with insertion holes 5*f* formed in an approximately oval shape for inserting the two support rods 4. Also, the linking section 5*e* has a U-shaped cross section that encompasses the two support rods 4. The linking section 5*e*, with a control section 5*g* (shown in FIGS. 4, 6, and 7) which is inner surfaces of the U-shaped cross section, accommodates the two support rods 4 within the inner portion of the U-shape cross section to control the amount of bending of the two support rods 4. Also, the resinous cap unit 6 has a diameter of about 6 mm, and also has a slit 6*a* for inserting both ends of the two support rods 4, which have a diameter of about 2.26 mm.

Figure 5:
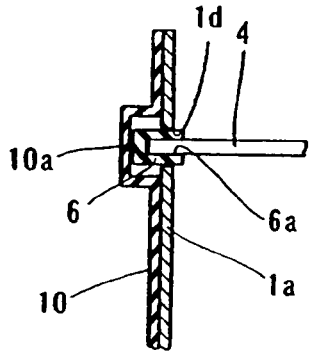
FIG. 5 is a partial cross-sectional view of the chassis, the bearing plate, and the cap unit of the heat transfer printer according to the embodiment shown in FIG. 1, as taken where the cap unit is coupled to the insertion hole of the chassis and viewed in the front-rear direction of the heat transfer printer.
Figure 6:
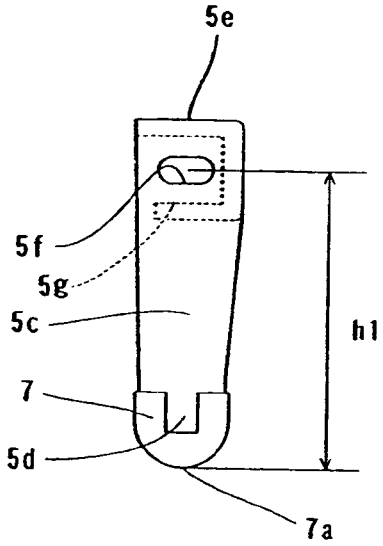
FIG. 6 is a front view of the second side arm of the rotary member of the heat transfer printer according to the embodiment shown in FIG. 1, as viewed in the direction of the arrow C shown in FIG. 4.
Figure 7:
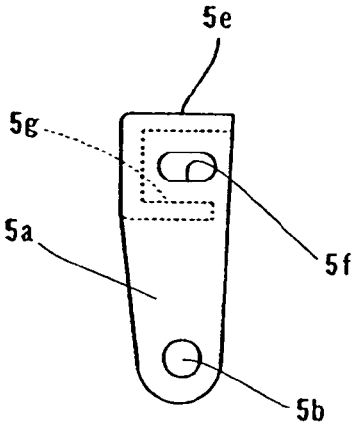
FIG. 7 is a front view of the first side arm of the rotary member of the heat transfer printer according to the embodiment shown in FIG. 1, as seen from the direction of the arrow D shown in FIG. 4.

As shown in FIG. 5, the cap unit.6 mounted on the ends of the two support rods 4 is inserted into the insertion holes 1*d* of the first side surface 1*a* and second side surface l*b* in the chassis 1, and is pivotally supported in the chassis 1. The resinous pressing member 7 is mounted on the distal end of the pressing part 5*d* of the second side arm 5*c* of the metal pivoting member 5, as shown in FIGS. 4 and 6. As shown in FIG. 2, the pressing part 5*d* of the pivoting member 5 is disposed so as to apply pressure in the vicinity of the center of the thermal head 2 in the width direction (the direction of the arrow A in FIG. 2) by pivoting.

Another feature of the present embodiment is that, as shown in FIGS. 6 and 9, the height h1 from the distal end 7*a* of the pressing member 7 mounted on the pressing part 5*d* to the center of the insertion hole 5*f* in the second side arm 5*c* of the pivoting member 5 is formed to be greater than the height h2 (see FIG. 9) from the top surface 2*c* of the thermal head 2 during the printing operation to the centers of the insertion holes 1*d* in the chassis 1. Accordingly, the two piano-wire support rods 4 that are capable of undergoing bending deformation bend upward when pressure is applied to the thermal head 2. Another feature of the present embodiment is that the drive gear 8 is provided with a cam groove 8*a* that engages the first side arm 5*a* of the pivoting member 5, as shown in FIGS. 1 and 8.

As shown in FIGS. 1, 2, and 3, the torsion coil spring 9 is mounted on the support axle 2*a* of the thermal head 2. The torsion coil spring 9 functions to urge the thermal head 2 in a direction away from the platen roller 3. Also, as shown in FIGS. 1 through 3, the bearing plate 10 is mounted on the outer side of the first side surface 1*a* of the chassis 1, and the bearing plate 11 is mounted on the outer side of the second side surface 1*b* of the chassis 1. As shown in FIGS. 2 and 5, the bearing plate 10 is provided with a stopper 10*a* for preventing the cap unit 6 from coming loose. As shown in FIGS. 1 and 2, the bearing plate 11 is also provided with a stopper 11*a* for preventing the cap unit 6 from coming loose.

As shown in FIGS. 1 through 3, a platen roller bearing 10*b* for rotatably supporting the platen roller 3 is formed integrally with the bearing plate 10. Also, as shown in FIGS. 2 and 3, a platen roller bearing 11*b* for rotatably supporting the platen roller 3 is formed integrally with the bearing plate 11. As shown in FIG. 3, the drive force of the motor 12 mounted on the motor bracket 13 is transmitted from the motor axle gear 12*a* to the drive gear 8 via the large gear 14*a* and small gear 14*b* of the intermediate gear 14.

Operation

FIGS. 10 through 13 are diagrams for describing the operation in which the thermal head 2 applies pressure to the platen roller 3 in the heat transfer printer according to the embodiment of the present invention. The operation in which the thermal head applies pressure to the platen roller in the heat transfer printer according to the embodiment of the present invention will be described with reference to FIGS. 1 through 3 and FIGS. 8 through 13.

First, in the initial state, as shown in FIGS. 1, 2, 10, and 11, the thermal head 2 is pivoted in a direction away from the platen roller 3 by the urging force of the torsion coil spring 9, and the pivoting member 5 is positioned at a position in which the pressing part 5*d* on which the pressing member 7 is mounted does not press on the top surface 2*c* of the thermal head 2.

Figure 13:
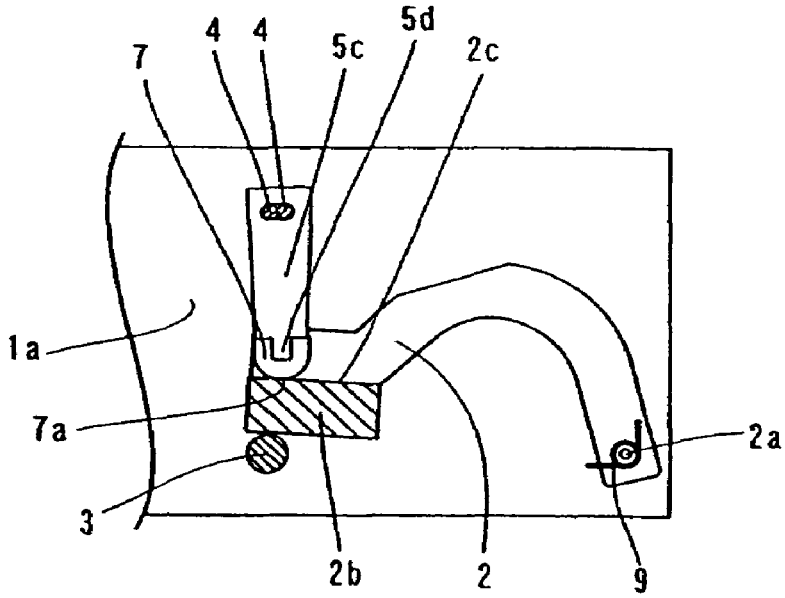
FIG. 13 is a schematic side view of the first side surface of the heat transfer printer according to the embodiment shown in FIG. 1, showing the relationship between the positions of the thermal head and the rotary member when the rotary member is pressing the thermal head.
Figure 14:
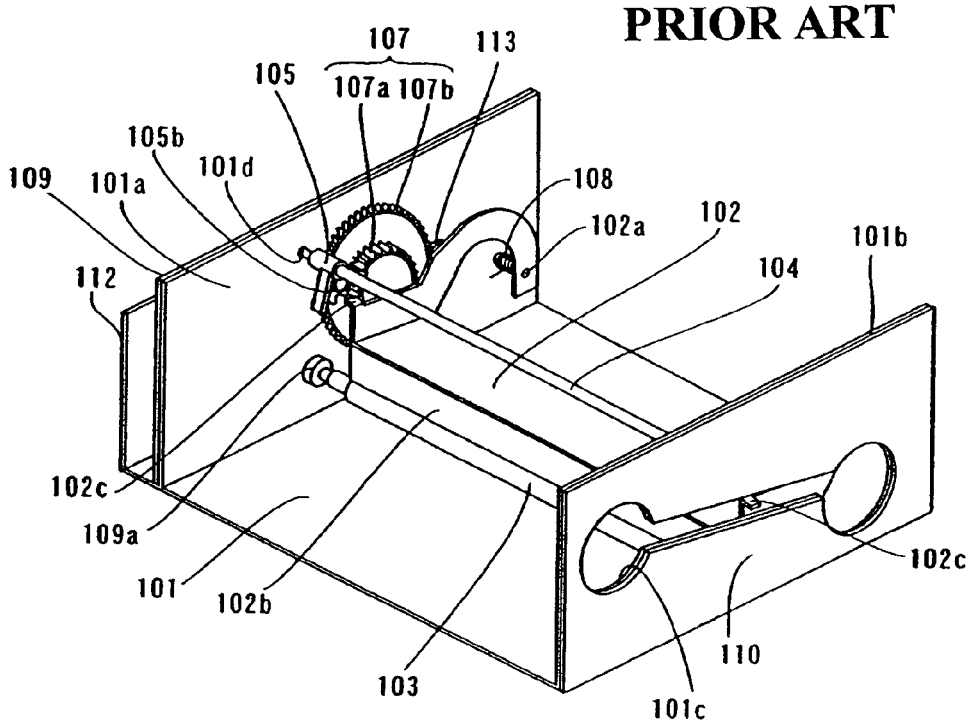
Figure 14 PRIOR ART
FIG. 14 is a perspective view of a conventional heat transfer printer.
Figure 15:
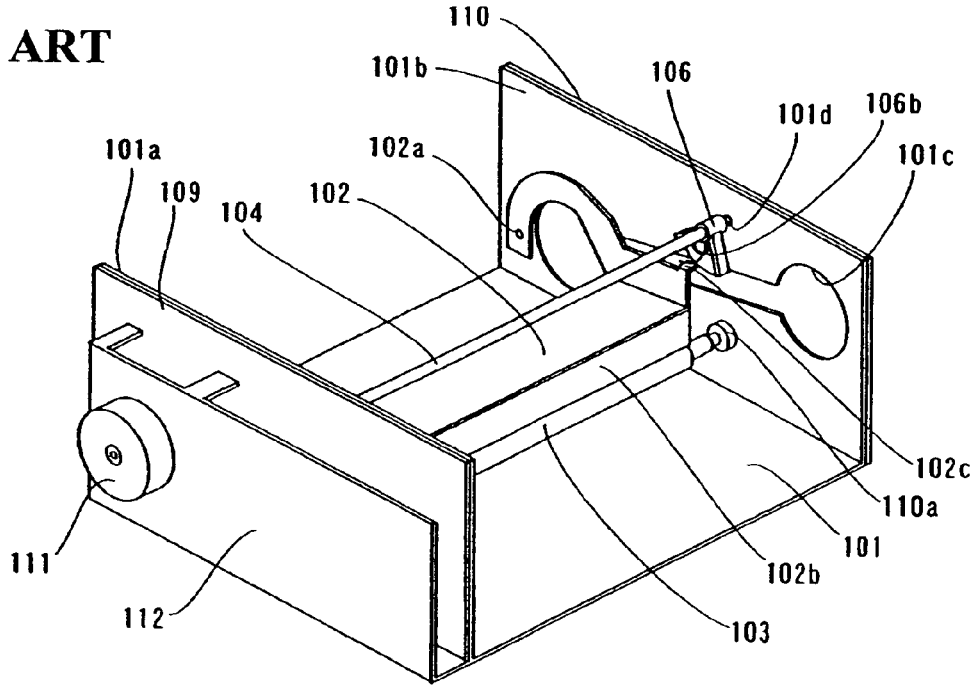
Figure 15 PRIOR ART
FIG. 15 is a perspective view of the conventional heat transfer printer shown in FIG. 14.
Figure 16:
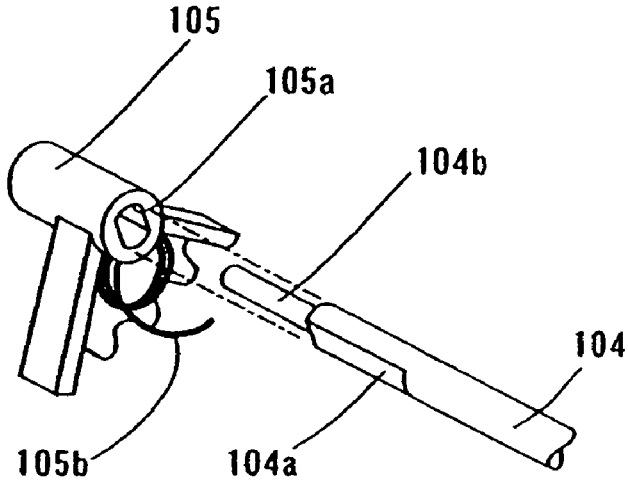
Figure 16 PRIOR ART
FIG. 16 is a cross-sectional view of the pressing member and the support rod used in the conventional heat transfer printer shown in FIGS. 14 and 15.
Figure 17:
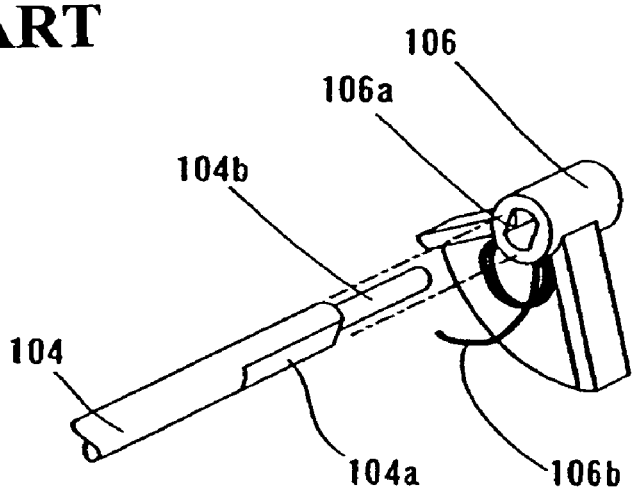
Figure 17 PRIOR ART
FIG. 17 is perspective view for describing the mounting structure of the pressing member and the support rod used in the conventional heat transfer printer shown in FIGS. 14 and 15.
Figure 18:
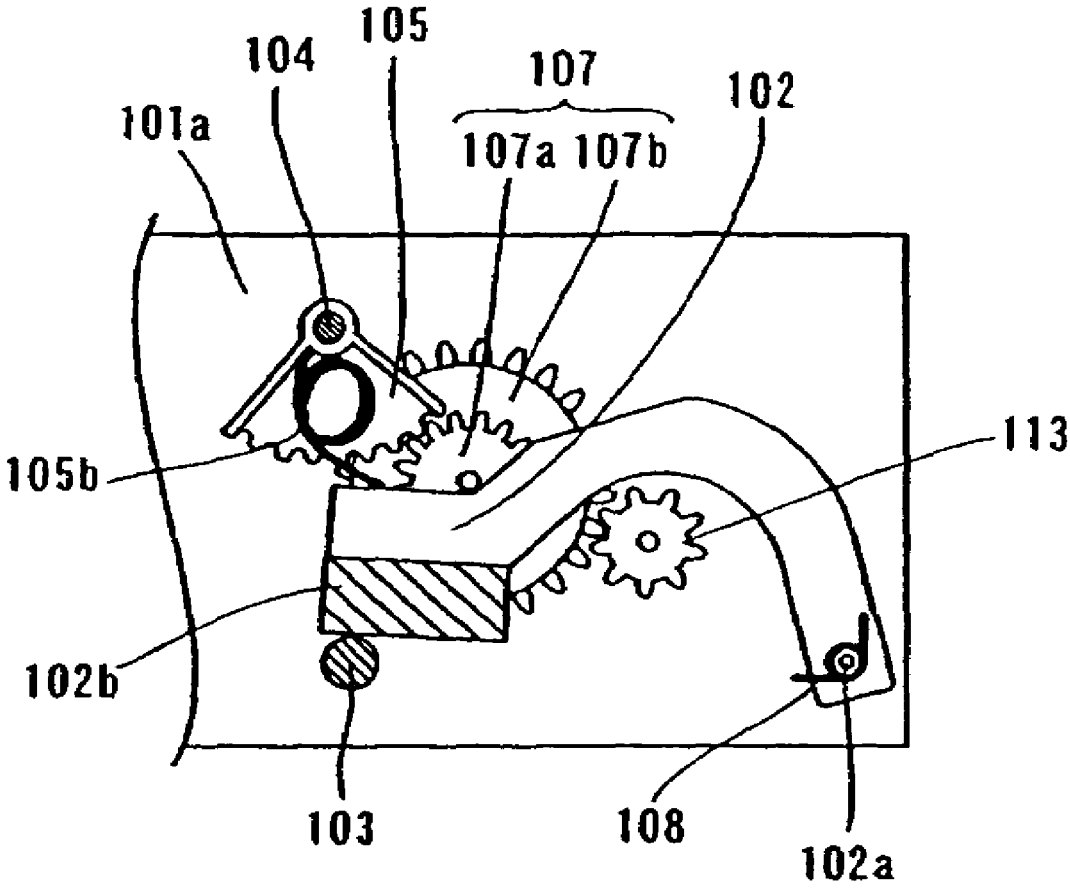
Figure 18 PRIOR ART
FIG. 18 is a schematic side view of the first side surface of the conventional heat transfer printer shown in FIGS. 14 and 15, showing the operation in which the thermal head applies pressure to the platen roller.

From this state, as shown in FIG. 3, the drive force of the motor 12 is transmitted from the motor axle gear 12*a* to the first side arm 5*a* of the pivoting member 5, via the large gear 14*a* and small gear 14*b* of the intermediate gear 14, and via the cam pin 5*b* of the first side arm 5*a* of the pivoting member 5 that engages the cam groove 8*a* of the drive gear 8. The first side arm 5*a* of the pivoting member 5 is thereby pivoted in the direction of the arrow E in FIG. 10 from the state shown in FIG. 10 to the state shown in FIG. 12, and the second side arm 5*c* of the pivoting member 5 therefore pivots in the direction of the arrow F in FIG. 11 from the state shown in FIG. 11 to the state shown in FIG. 13. The pressing member 7 mounted on the pressing part 5*d* of the second side arm 5*c* of the pivoting member 5 thereby comes into contact with the top surface 2*c* of the thermal head 2, as shown in FIGS. 8, 9, and 13.

At this time, as shown in FIG. 9, the height h1 from the distal end 7*a* of the pressing member 7 mounted on the pressing part 5*d* of the second side arm 5*c* of the pivoting member 5 to the center of the insertion hole 5*f* is formed to be greater than the height h2 from the top surface 2*c* of the thermal head 2 during the printing operation to the centers of the insertion holes 1*d* in the chassis 1. The two piano-wire support rods 4, which are capable of undergoing bending deformation, therefore bend upward. Bending stress is thereby created in the two piano-wire support rods 4, and the pressing member 7 mounted on the pressing part 5*d* is therefore pressed against the top surface 2*c* of the thermal head 2 in the direction of the arrow B in FIG. 2 by this bending stress. As a result, the head unit 2*b* of the thermal head 2 is pressed against the platen roller 3.

In the present embodiment, as described above, a U-shaped pivoting member 5 has the two piano-wire support rods 4 that are capable of undergoing bending deformation, the first side arm 5*a* that is mounted on the support rods 4 and engages the cam groove 8*a* of the drive gear 8, the second side arm 5*c* having the pressing part 5*d*, and the linking section 5*e* that links the first side arm 5*a* and the second side arm 5*c*. The pressing part 5*d* of the second side arm 5*c* of the pivoting member 5 is configured so as to press the thermal head 2 against the platen roller 3 using the pressure from the bending deformation of the two support rods 4 composed of piano wire. Accordingly, the thermal head 2 can be pressed against the platen roller 3 with a sufficient amount of pressure by utilizing the bending stress from the bending deformation of the two support rods 4 composed of piano wire during the printing operation.

Another feature of the present embodiment is that, by providing two support rods 4 to the pivoting member 5, it is possible to reduce the cross sectional area of each support rod necessary as compared to the case when a single support rod is used while generating equivalent pressure with the same amount of bending. The amount of deflection δ of a simple beam whose cross section is circular is generally expressed as follows:

$$\delta = WL^3/48EI$$

$$I = \pi d^4/64$$

where W is the load to the simple beam, L is the span of the beam, E is the Young's modulus, I is the geometrical moment of inertia, and d is the diameter of the simple beam. Clearly, the deflection δ becomes greater as the diameter d of the simple beam becomes smaller. Thus, the support rods 4 that have a smaller cross sectional area bend more easily.

Since the support rods 4 with a reduced cross sectional area bend more easily than a support rod with a larger cross sectional area, it is possible to control the amount of deflection of the support rods 4 more easily. Particularly, when there is a dimensional error in the support rods 4, such dimensional error is less likely to affect the printing operation, since the dimensional error can be absorbed by the deflection of the support rods 4.

Furthermore, as described above, the maximum possible amount of bending of the support rods 4 is greater than that of the larger single support rod. When a support rod whose maximum possible amount of bending is small is deflected repeatedly, the support rod tends to be non-reversibly deformed. In the present invention, however, by using the two support rods 4 with a greater allowable amount of bending, it is possible to efficiently prevent plastic deformation in the support rods 4 even after the repeated use of the support rods 4.

Another feature of the present embodiment is that mounting the resinous pressing member 7 on the distal end of the pressing part 5*d* of the metal pivoting member 5 makes it possible to bring the resinous pressing member 7 into contact with the top surface 2*c* of the thermal head 2 when pressure is applied to the thermal head 2. As a result, it is possible to prevent the thermal head 2 from being damaged as a result of the metal pivoting member 5 coming into contact with the thermal head 2.

Another feature of the present embodiment is that, by inserting the ends of the two support rods 4 through the cap unit 6 pivotally supported in the chassis 1, it is possible to easily pivot the pivoting member 5 which is mounted on the two support rods 4 in relation to the chassis 1.

Another feature of the present embodiment is that, by providing the linking section 5*e* of the pivoting member 5 with a control section 5*g* for controlling the amount of bending of the two support rods 4 which are made of piano wire, it is possible to ensure that the two support rods 4 do not bend excessively. As a result, it is possible to suppress plastic deformation of the support rods 4 that may result from excessive bending.

Another feature of the present embodiment is that, by providing the drive gear 8 with a cam groove 8*a* and providing the first side arm 5*a* of the pivoting member 5 with a cam pin 5*b* that engages the cam groove 8*a*, it is possible to transmit the drive force of the drive gear 8 to the pivoting member 5 by using the cam groove 8*a* and the cam pin 5*b*. As a result, the pressing part 5*d* of the second side arm 5*c* of the pivoting member 5 can be pivoted easily.

Another feature of the present embodiment is that, by placing the pressing part 5*d* of the second side arm 5*c* of the pivoting member 5 so as to apply pressure in the vicinity of the center of the thermal head 2 in the width direction (the direction of the arrow A in FIG. 2), it is possible to apply transversely balanced pressure to the thermal head 2 in the width direction of the thermal head 2 (in the direction of the arrow A in FIG. 2) with the pressing part 5*d* of the second side arm 5*c* of the pivoting member 5. Accordingly, occurrences of printing non-uniformities can be reduced because the thermal head 2 can be pressed against the platen roller 3 with transversely balanced pressure.

Another feature of the present embodiment is that, as a result of a configuration wherein the pivoting member 5 is a U-shaped member, with the first side arm 5*a*, the second side arm 5*c* having the pressing part 5*d*, and the linking section 5*e* that links the first side arm 5*a* and the second side arm 5*c*, there is no idling between the first side arm 5*a* and the second side arm 5*c* of the pivoting member 5 when the first side arm 5*a* is pivoted by the cam groove 8*a* of the drive gear 8. Therefore, there is no need to form D-cuts or oval shapes in the support rod in order to prevent such idling. The metal pivoting member 5 can thereby be formed quickly and easily by pressing without having to perform time-consuming cutting operations. Therefore, the time needed to form the pivoting member 5 for exerting pressure on the thermal head 2 can be reduced in the mechanism of the present invention, in which pressure is applied to the thermal head 2 using a pivoting member 5.

The embodiment currently disclosed should be considered as an example in all respects and not as being restrictive. The scope of the present invention is expressed by the patent claims and not by the above descriptions of the embodiment, and further includes the scope of the patent claims and its equivalents, including all possible variations.

For example, in the embodiment described above, a heat transfer printer is described as an example of an image forming apparatus. However, the present invention is not limited thereto, and can also be applied to image forming apparatuses other than heat transfer printers as long as it is an image forming apparatus having a printing head.

Also, in the embodiment described above, an example is given wherein a pressing part 5*d* applies pressure to the thermal head 2 by using the bending stress from the bending deformation of two support rods 4. However, the present invention is not limited to such structure, and may also be configured so that the pressure is applied to the thermal head by the pressing part by using the bending stress from the bending deformation of three or more support rods.

In the embodiment described above, an example is given wherein the pressing part applies pressure near the center of the thermal head in the width direction, but the present invention is not limited to such structure. The pressing part may also be designed to apply pressure to portions other than the center of the thermal head in the width direction.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2004-197855. The entire disclosure of Japanese Patent Application No. 2004-197855 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus, comprising:

a chassis;

a head portion pivotally supported on the chassis;

a platen roller rotatably supported on the chassis opposite the head portion;

a plurality of elastically deformable support rods rotatably supported on the chassis;

a U-shaped rotary member pivotally supported to the chassis by unrotatably engaging the support rods, the rotary member having a first side arm, a second side arm, and a linking section for linking the first side arm and the second side arm, the second side arm being configured to press the head portion against the platen roller with an urging force of the support rods; and a drive mechanism engaged with the first side arm of the rotary member to pivot the rotary member around the support rods, with the support rods serving as a pivot axis of the rotary member.

2. The image forming apparatus according to claim 1, wherein the rotary member is made of metal; and a resin-made pressing member is mounted on a distal end of the second side arm of the rotary member.

3. The image forming apparatus according to claim 1, further comprising a cap unit which is pivotally supported in the chassis and into which all ends of the plurality of support rods are inserted.

4. An image forming apparatus comprising:

a chassis;

a head portion pivotally supported on the chassis;

a platen roller rotatably supported on the chassis opposite the head portion;

a plurality of elastically deformable support rods rotatably supported on the chassis;

a U-shaped rotary member pivotally supported to the chassis by unrotatably engaging the support rods, the rotary member having a first side arm, a second side arm, and a linking section for linking the first side arm and the second side arm, the second side arm being configured to press the head portion against the platen roller with an urging force of the support rods; and a drive mechanism engaged with the first side arm of the rotary member to pivot the rotary member around the support rods, the linking section of the rotary member having a U-shaped cross sectional shape, the plurality of support rods being accommodated within the U-shaped cross sectional shape of the linking section.

5. The image forming apparatus according to claim 1, wherein the drive mechanism has a cam groove; and the first side arm of the rotary member has a cam pin for engaging the cam groove.

6. The image forming apparatus according to claim 1, wherein the second side arm of the rotary member is positioned substantially at a center in a width direction of the head portion.

7. The image forming apparatus according to claim 1, wherein the head portion is a thermal head.

8. The image forming apparatus according to claim 1, wherein the support rods are made of a piano wire.

9. A thermal transfer printer comprising:

a chassis;

a thermal head pivotally supported on the chassis and adapted to perform printing;

a platen roller rotatably supported on the chassis opposite the thermal head;

a plurality of elastically deformable metal support rods rotatably supported on the chassis;

a U-shaped rotary member pivotally supported to the chassis by unrotatably engaging the support rods, the rotary member having a first side arm, a second side arm, and a linking section for linking the first side arm and the second side arm, a resin-made pressing member being mounted on a distal end of the second side arm, the second side arm being adapted to press the thermal head against the platen roller with an urging force of the support rods, the linking section having a U-shaped cross sectional shape with the plurality of support rods being accommodated in the U-shaped cross sectional shape of the linking section, the second side arm being positioned substantially at a center in a width direction of the thermal head;

a drive mechanism having a cam groove that engages a cam pin formed in the first side arm of the rotary member to pivot the rotary member around the support rods; and a cap unit which is pivotally supported in the chassis and into which all ends of the plurality of support rods are inserted.

* * * * *